United States Patent [19]

Shevakin et al.

[11] 4,380,528

[45] Apr. 19, 1983

[54] SILVER-BASED ALLOY

[76] Inventors: Jury F. Shevakin, Telegrafny pereulok, 11/16, kv. 53; Efim S. Shpichinetsky, ulitsa Donskaya, 6, kv. 93; Valentina P. Fedorenko, Teply Stan, 7 mikroraion, 108, kv. 107; Boris N. Efremov, ulitsa Veernaya, 26, korpus 1, kv. 17; Maria N. Klevchenkova, ulitsa F. Poletaeva, 8, korpus 4, kv. 59; Ivan A. Andrjuschenko, Molodezhnaya ulitsa, 4, kv. 321; Iosif A. Krasnoselsky, ulitsa Profsojuznaya, 102/47, kv. 6; Evgeny F. Anikeev, ulitsa Butlerova, 14, korpus 1, kv. 29; Evgeny A. Ivanov, Universitetsky prospekt, 4, kv. 228; Anatoly P. Khomyachkov, ulitsa Miklukho-Maklaya, 45, kv. 59, all of Moscow; Naum A. Shvarts, prospekt K. Marxa, 80, kv. 38; Ljudmila V. Kozhevnikova, prospekt Metallistov, 84, kv. 51, both of Leningrad; Roza M. Romanova, Profsojuznaya ulitsa, 79, korpus 2, kv. 10; Alexandr D. Zhivotchenko, ulitsa Zoi Kosmodemyanskoi, 34"A", kv. 39, both of Moscow, all of U.S.S.R.

[21] Appl. No.: 260,861

[22] Filed: May 6, 1981

[51] Int. Cl.[3] ..... C22C 5/06

[52] U.S. Cl. ..... 420/505

[58] Field of Search ..... 75/173 R, 172 G; 420/505

[56] References Cited

U.S. PATENT DOCUMENTS

| | | | |
|---|---|---|---|
| 2,258,492 | 10/1941 | Hensel et al. | 75/173 R |
| 3,117,894 | 1/1964 | Coke | 148/11.5 |

FOREIGN PATENT DOCUMENTS

| | | | |
|---|---|---|---|
| 291980 | 1/1971 | U.S.S.R. | 75/173 R |
| 416404 | 7/1974 | U.S.S.R. | 75/173 R |
| 435296 | 11/1974 | U.S.S.R. | 75/173 R |

OTHER PUBLICATIONS

C. K. Barker, *Product Engineering,* 1964, 35, No. 10, p. 62.

*Primary Examiner*—L. Dewayne Rutledge
*Assistant Examiner*—David Hey
*Attorney, Agent, or Firm*—Ladas & Parry

[57] ABSTRACT

A silver-based alloy incorporating palladium, magnesium and aluminium in the following proportions of the components, percent by weight:

| | |
|---|---|
| palladium | 5 to 30 |
| magnesium | 0.1 to 0.5 |
| aluminium | 0.01 to 0.5 |
| silver | the balance. |

The alloy of the above-specified composition, in contrast to the known silver-based alloys, possesses a sufficiently high plasticity (relative elongation of the alloy after the internal oxidation thereof is as high as 25%), while retaining a high level of mechanical strength, elasticity, electro-contact and corrosion-resistance properties.

1 Claim, No Drawings

SILVER-BASED ALLOY

FIELD OF THE INVENTION

The present invention relates to metallurgy and, more particularly, to silver-based alloys.

These alloys are useful as a material for interrupting and sliding electrical contacts and flexible-contact members in various devices (relays, switches, potentiometers and the like) commutating currents of from 1 μA to 25 A at voltages of from 1 μV to 250 V.

BACKGROUND OF THE INVENTION

Known in the art is a silver-based alloy consisting of 70% by weight of silver and 30% by weight of palladium (cf. TGC 12736, GDR Standard).

This alloy, however, is used only for the manufacture of rivet and stud contacts. The low level of elastic properties of this alloy does not enable its use for the manufacture of flexible-contact members. Furthermore, contacts manufactured from this alloy have a low erosion resistance.

Known in the art are contact-spring multi-component alloys based on expensive noble metals—gold and platinum.

Such alloys have the following composition, % by weight: 1. gold—72, copper—14, silver—4, platinum—9, zinc—1.2. palladium—35, silver—30, platinum—10, gold—10, copper—14, zinc—1. (cf. C. K. Barker, Product Engineering, 1964, 35, No. 10, p. 62).

These alloys possess a good combination of electrocontact and elastic properties. However, a high specific electrical resistance and insufficient thermal conductivity of these alloys restrict fields of their application. Furthermore, the procedure of production of these alloys is rather complicated and labour-consuming. An essential disadvantage also resides in the presence of expensive noble metals—gold and platinum—in their compositions.

Known in the art are less-alloyed contact-spring alloys based on silver reinforced by an internal oxidation (oxidizing heat-treatment) incorporating, % by weight: magnesium—0.3, nickel—0.2, silver—the balance (cf. U.S. Pat. No. 3,117,894 of Jan. 14, 1964; Cl. 148-11.5) or palladium—20, magnesium—0.3, silver—the balance (USSR Inventor's Certificate No. 291980, "Bulletin for Discoveries, Inventions, Industrial Designs and Trademarks", No. 4, 1971, p. 85, Cl. C 22 c, 5/06) at a satisfactory level of durability, flexibility and electrocontact properties possess a low plasticity after internal oxidation (relative elongation does not exceed 4%). This substantially reduces the service life of springs made therefrom under cyclic loads and does not provide for the possibility of internally oxidized semi-finished articles (bands and wire) from these alloys for the manufacture of monometallic contacts and bimetals.

Furthermore, the prior art silver-based alloy incorporating magnesium and nickel has a low corrosion resistance in sulphur-containing media.

SUMMARY OF THE INVENTION

It is an object of the present invention to provide such a silver-based alloy which would have a sufficiently high plasticity at a high level of mechanical strength, elasticity, electrocontact and corrosion-resistance properties.

These and other objects of the present invention are accomplished by a silver-based alloy incorporating palladium and magnesium, wherein, according to the present invention aluminium is additionally contained, the components being present in the following proportions, percent by mass:

| | |
|---|---|
| palladium | 5 to 30 |
| magnesium | 0.1 to 0.5 |
| aluminium | 0.01 to 0.5 |
| silver | the balance. |

At a content of palladium below 5% the required level of electrocontact and corrosion properties is not attained. The aloy containing palladium in an amount of above 30% by weight has a high resistivity, a low effect of reinforcement after the oxidizing heat-treatment; the duration of the oxidizing heat-treatment process is substantially increased. This complicates the process of manufacturing articles from this alloy.

At a content of magnesium below 0.1% by weight during the process of internal oxidation a high level of mechanical strength of the alloy and, hence, a high level of erosion resistance of the contacts made therefrom are not attained. The alloy containing magnesium in an amount of above 0.5% by weight has a high electrical resistivity, possesses a structure with large-size particles of magnesia thus causing increased brittleness of the alloy.

At a content of aluminium below 0.01% by weight the alloy does not possess a stable fine-grain structure, wherefore after the internal oxidation the alloy has a low plasticity (relative elongation of about 5%). The content of aluminium in the alloy above 0.5% by weight causes impaired electrocontact properties of the alloy and increased duration of its oxidizing heat-treatment.

The alloy according to the present invention (after the internal oxidation by the known method) possesses high mechanical, elastic, electrocontact properties and increased corrosion resistance at a sufficiently high plasticity.

The alloy has a low electrical resistivity $$\left(0.08 \text{ to } 0.16 \frac{\text{Ohm} \cdot \text{mm}^2}{\text{m}}\right),$$

as well as a low stable contact electrical resistance (10 to 50 mOhm) both before and after residence in sulphur-containing media; micro-hardness of the alloy is as high as 200 kgf/mm$^2$. The high mechanical strength of the alloy (ultimate tensile strength is 55 kgf/mm$^2$) and high eleastic properties (limit of elasticity is 50 kgf/mm$^2$ at the residual deformation tolerance of 0.005%) are well combined with a high plasticity (relative elongation is as high as 25%).

DETAILED DESCRIPTION OF THE INVENTION

The silver-based alloy according to the present invention can be produced by a known method of melting the same in an induction furnace at a temperature within the range of from 1200° to 1400° C. in vacuum or atmosphere of an inert gas. The resulting alloy is cast into a graphite or iron mould. From the thus-produced ingot semi-finished articles are produced, e.g. wire or strips by the method of cold deformation (drawing or rolling respectively) with total reduction of 60 to 90% and intermediate annealing in vacuum at a temperature of from 400° to 700° C.

From the thus-produced semi-finished blanks articles are manufactured (rivet, stud, flat contacts, contact-flexible members, as well as collector brushes.

The oxidizing heat-treatment can be effected with both the semi-finished products and articles therefrom; the process is conducted in the air or oxygen atmosphere at a temperature within the range of from 700° to 950° C.

In this manner the alloy according to the present invention can be successfully employed as a material for electric contacts of different types (rivet, stud, flat), contact-flexible members, as well as brushes for collectors.

The contacts produced from this alloy ensure a reliable commutation in AC and DC circuits with active and inductive load at a current and voltage per one contact pair within the following ranges:

current: from 1 μA to 10 A;

voltage: from 1 μV to 250 V.

A current of up to 25 A is allowed to pass through a closed contact pair within a short time period.

The instruments (relays, switches, potentiometers and the like), wherein use is made of contacts manufactured from the alloy according to the present invention have an extended service life.

The alloy according to the present invention has a good processibility. It can be readily employed for the manufacture of semi-finished products in the shape of wire, strips, flattened band, tubes, as well as for moulding from the semi-finished blanks, shaped contacts of various dimensions.

In the internally-oxidized state the alloy possesses a sufficiently high plasticity in combination with high mechanical strength characteristics. This enables stamping contacts and manufacture of bimetallic compositions from the internally-oxidized wire and strips.

The contact-flexible elements made from this alloy withstand more than $10^7$ cycles of symmetric load equal to 25 kgf/mm$^2$.

The alloy possesses a low and stable contact electric resistance and a high corrosion resistance in a sulphur-containing medium. As regards its corrosion resistance, it is superior over the prior art corrosion-resistant alloy consisting of 70% by weight of silver and 30% by weight of palladium.

The alloy according to the present invention contains no expensive noble metals—gold and platinum—and is an efficient substituent for known alloys based on said metals.

For a better understanding of the present invention a specific example illustrating its particular embodiment is given hereinbelow.

EXAMPLE

A silver-based alloy is produced which has the following composition, percent by weight:

| | |
|---|---|
| palladium | 20 |
| magnesium | 0.3 |
| aluminium | 0.5 |
| silver | 79.2. |

For the production of this alloy a charge is prepared from silver, palladium, magnesium and aluminium. This charge is placed into a vacuum induction furnace in a graphite crucible, wherein the alloy is smelted at a temperature within the range of from 1,250° to 1,300° C. The alloy is cast into an iron mould of a predetermined shape ensuring the production of a solid and dense ingot. After the removal of the casting defects from the ingot surface semi-finished products—strips or wire—are made therefrom by cold-deformation methods (rolling, drawing) with total reduction of from 60 to 70% and intermediate annealings in vacuum at the temperature of 600° C. for one hour.

From the thus-produced semi-finished blanks contact-flexible members are stamped which are subjected to an oxidizing heat-treatment in air at the temperature of 880°±10° C. for 2 hours.

Alloys based on silver but with different proportions of the components can be produced in a similar manner.

Properties of the silver-based alloy according to the present invention at different ratios between the components (after the internal oxidation of the alloy) are shown in the Table hereinbelow.

The contact electrical resistance $R_c$ of the alloy is measured in a pair with a gold contact using wire samples with the diameter of 0.85 mm. The measurements are carried out on samples after residence thereof for 24 hours in a humid medium containing 1 mg/l of hydrogen sulphide.

The conditions for measurements of the contact electrical resistance are as follows:

| | |
|---|---|
| voltage | 6 V |
| current | 0.1 A |
| contact pressure | 20 G. |

As it is seen from the Table, the mechanical strength, elasticity and electrocontact characteristics, as well as corrosion resistance of the alloy according to the present invention are not inferior and in some cases are even superior to the same properties of the known silver-based alloys. The alloy according to the present invention (after the internal oxidation thereof) features a substantially higher plasticity than the above-mentioned prior art alloys. The relative elongation of the alloy according to the present invention is by 7–10 times higher than corresponding values of relative elongation of the known alloys.

TABLE

| Alloy 1 | Composition, % by weight 2 | Resistivity, $\rho$ $\frac{\text{Ohm} \cdot \text{mm}^2}{\text{m}}$ 3 | Contact electric resistance, $R_c$, mOhm 4 |
|---|---|---|---|
| Known | Silver - 70<br>Palladium - 30<br>(strained) | 0.16 | 30–45 |
| Known | Palladium - 20<br>Magnesium - 0.3<br>Silver - the balance | 0.11 | 25–30 |
| Of the present invention | Palladium - 5<br>Magnesium - 0.1<br>Aluminium - 0.2<br>Silver - the balance | 0.08 | 45–60 |
| Of the present invention | Palladium - 30<br>Magnesium - 0.5<br>Aluminium - 0.01<br>Silver - the balance | 0.16 | 5–10 |
| Of the pre- | Palladium - 20 | | |

TABLE-continued

| | | | |
|---|---|---|---|
| sent invention | Magnesium - 0.3<br>Aluminium - 0.5<br>Silver - the balance | 0.14 | 10–15 |

| Microhardness, kgf/mm² Hμ | Tensile strength, $\sigma_b$, kgf/mm² | Limit of elasticity, $\sigma$ 0.005 kgf/mm² | Relative elongation, % |
|---|---|---|---|
| 5 | 6 | 7 | 8 |
| 140 | 65 | 22 | 2 |
| 190 | 48 | 35 | 2 |
| 110 | 40 | 30 | 25 |
| 220 | 55 | 50 | 15 |

TABLE-continued

| | | | |
|---|---|---|---|
| 150 | 50 | 40 | 20 |

What is claimed is:

1. A silver-based alloy incorporating palladium, magnesium and aluminium in the following proportions of the components, percent by weight:

| | |
|---|---|
| palladium | 5 to 30 |
| magnesium | 0.1 to 0.5 |
| aluminium | 0.01 to 0.5 |
| silver | the balance. |

* * * * *